US005718626A

United States Patent [19]

Rindoks et al.

[11] Patent Number: 5,718,626

[45] Date of Patent: Feb. 17, 1998

[54] FUME HOOD CABLE SYSTEM

[75] Inventors: Kurt Rindoks, Davidson; Karole Clanton, Stoney Point, both of N.C.

[73] Assignee: Kewaunee Scientific Corporation, Statesville, N.C.

[21] Appl. No.: 573,434

[22] Filed: Dec. 15, 1995

[51] Int. Cl.[6] ..... B08B 15/02

[52] U.S. Cl. ..... 454/56; 49/445

[58] Field of Search ..... 454/56, 61, 62; 49/445, 447

[56] References Cited

U.S. PATENT DOCUMENTS

| | | | |
|---|---|---|---|
| 3,025,780 | 3/1962 | Russell . | |
| 3,934,496 | 1/1976 | Turko | 454/56 |
| 4,150,606 | 4/1979 | Nelson . | |
| 4,377,969 | 3/1983 | Nelson | 454/59 |
| 5,241,788 | 9/1993 | Buie | 454/62 X |

FOREIGN PATENT DOCUMENTS

| | | | |
|---|---|---|---|
| 67278 | 2/1958 | France | 49/445 |
| 2 327 381 | 5/1977 | France | 49/445 |

*Primary Examiner*—Harold Joyce

*Attorney, Agent, or Firm*—Hill, Steadman & Simpson

[57] ABSTRACT

A tension adjusting sash suspension arrangement for a vertically reciprocal sash for a fume hood having a cable connected to opposite sides of the sash, threaded over front corner pulleys, threaded around rear corner pulleys, threaded through a tension adjusting mechanism and directed downwardly to a common counter weight. The tension adjusting mechanism includes two laterally arranged pulleys mounted rotatably on a sliding bracket. The sliding bracket is slidable along a fixed bracket and fixable in selected position along a slot. The cable lengths are adjusted by loosening the sliding bracket with respect to the fixed bracket and allowing the counter weight to take up all tension in the cables, and then fixing the sliding bracket in position. The sash counter weight system can be precisely adjusted for proper vertical movement of the sash without binding caused by a skewed travel.

15 Claims, 2 Drawing Sheets

FUME HOOD CABLE SYSTEM

BACKGROUND OF THE INVENTION

The present invention relates to laboratory fume hoods and in particular to a sash counter weight system for raising and lower a vertically hung sash or combination vertical and horizontal sash for a laboratory fume hood.

Laboratory fume hoods are cabinet-like structures having an open front for access into the cabinet, the open front closeable by a sash, typically transparent. Laboratory work on specimens or experiments involving noxious, volatile or otherwise undesirable materials are conducted within the cabinet. A means is provided for sweeping the cabinet with air for removing undesirable fumes or airborne materials to a place outside the immediate area of the cabinet.

For a vertically hung sash or combination vertical and horizontal sash for a laboratory fume hood, the sash is typically connected via cables to a counter weight arranged on a back side of the cabinet. Typically, the sash is connected at opposite corners by individual cables which are arranged via pulleys to a common termination point in either the back or side of the cabinet and connected to a common counter weight. A problem that can arise with this system is the proper adjustment of the lengths of the cables to ensure that the edges of the sash remain parallel to the sash tracks. If the cable lengths are not adjusted properly, the sash can tip to one side or the other, causing opposite corners to come into contact with the sash tracks which interferes with the smooth operation of the sash. Typically a turn buckle is used to manually adjust these cable lengths.

SUMMARY OF THE INVENTION

It is an object of the present invention to provide a self adjusting sash counter weight system which assures the smooth vertical reciprocation of the sash for a laboratory fume hood. It is an object of the present invention to provide a suspension system for the sash which can be easily placed in a self adjusting mode and then locked into place to prevent misoperation.

The objects are inventively achieved in an arrangement of pulleys and an adjusting mechanism for cable tension. The sash is hung by laterally arranged vertical cables which are turned 90° to the horizontal by front corner pulleys and directed rearwardly to rear corner pulleys to be turned 90° horizontally inwardly. The cables are then threaded through a cable tension adjusting arrangement, turned downwardly and connected to a counterweight. The cable tension adjusting mechanism provides two pulleys carried on a sliding bracket. The sliding bracket is adjustably fixed to a fixed bracket mounted to a top wall of the fume hood. To adjust the cable tension, i.e., to equally distribute cable tension between the laterally disposed cables (left and right sides of the sash) for smooth sash operation, the sliding bracket is freed to slide on the fixed bracket. The counterweight causes an equal distribution of tension on the lateral cables by forcing the sliding bracket to slide with respect to the fixed bracket. The sliding bracket is then fixed in position on the fixed bracket.

DETAILED DESCRIPTION OF THE PREFERRED EMBODIMENTS

Figure 1:
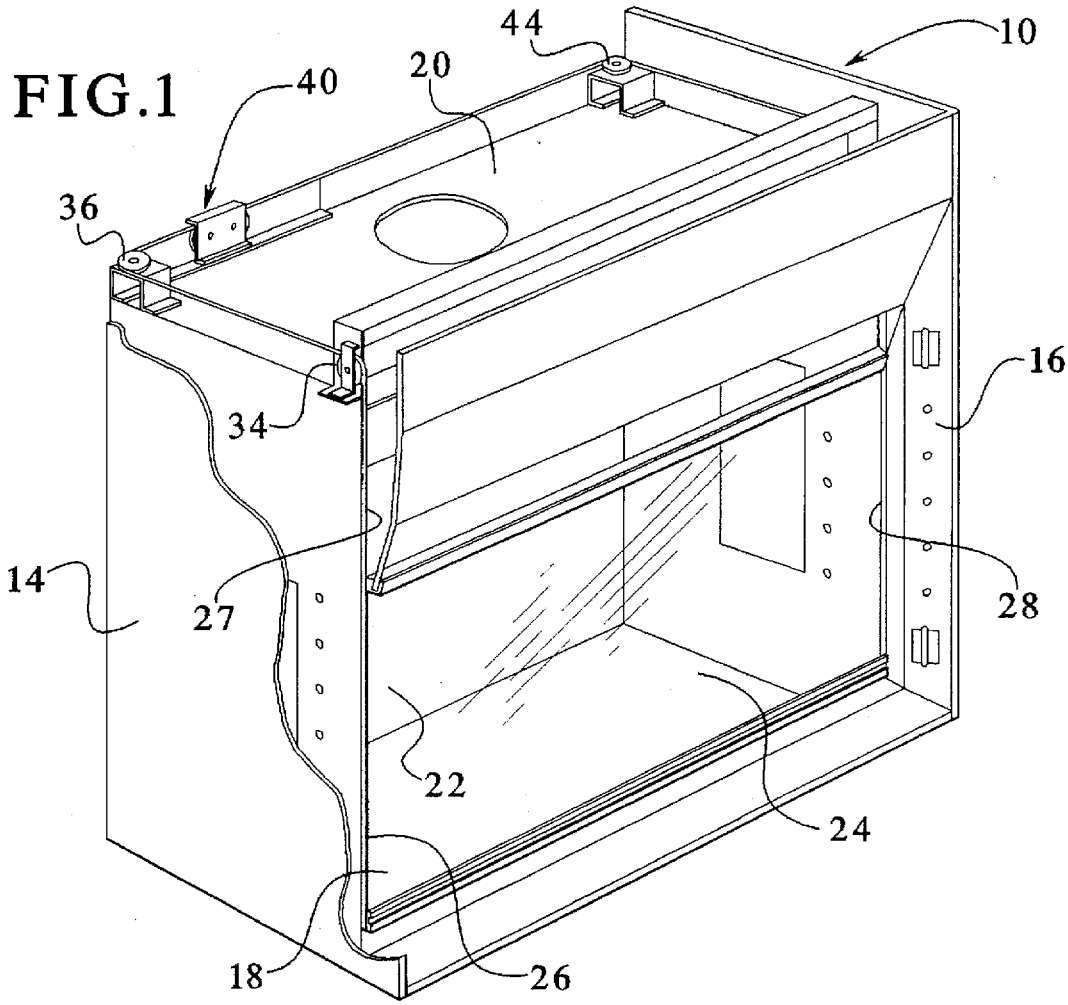
FIG. 1 is a partial perspective view of a fume hood according to the present invention.

FIG. 1 illustrates a fume hood 10 of the present invention having a first side wall 14, a second side wall 16, a bottom wall 18 and a top wall 20. A back wall 22 closes the back of the fume hood and a sash 24 partially closes a front of the fume hood. The sash 24 is guided for reciprocal movement in an open face of the fume hood. The sash 24 is connected at a first side 26 by a first cable 27 and at a second side 28 by a second cable 29. The first cable 27 rises vertically and is redirected over a front corner pulley 34 to a horizontal configuration toward the back wall 22 and deflected horizontally by 90° by a rear corner pulley 36 to a cable adjusting device 40 of the present invention. The cable 29 is deflected in a mirror image fashion, first from a vertical orientation to a horizontal orientation by a front corner pulley 42 and then horizontally by 90° by a rear corner pulley 44 toward the adjusting device 40 (see also FIG. 4).

Figure 4:
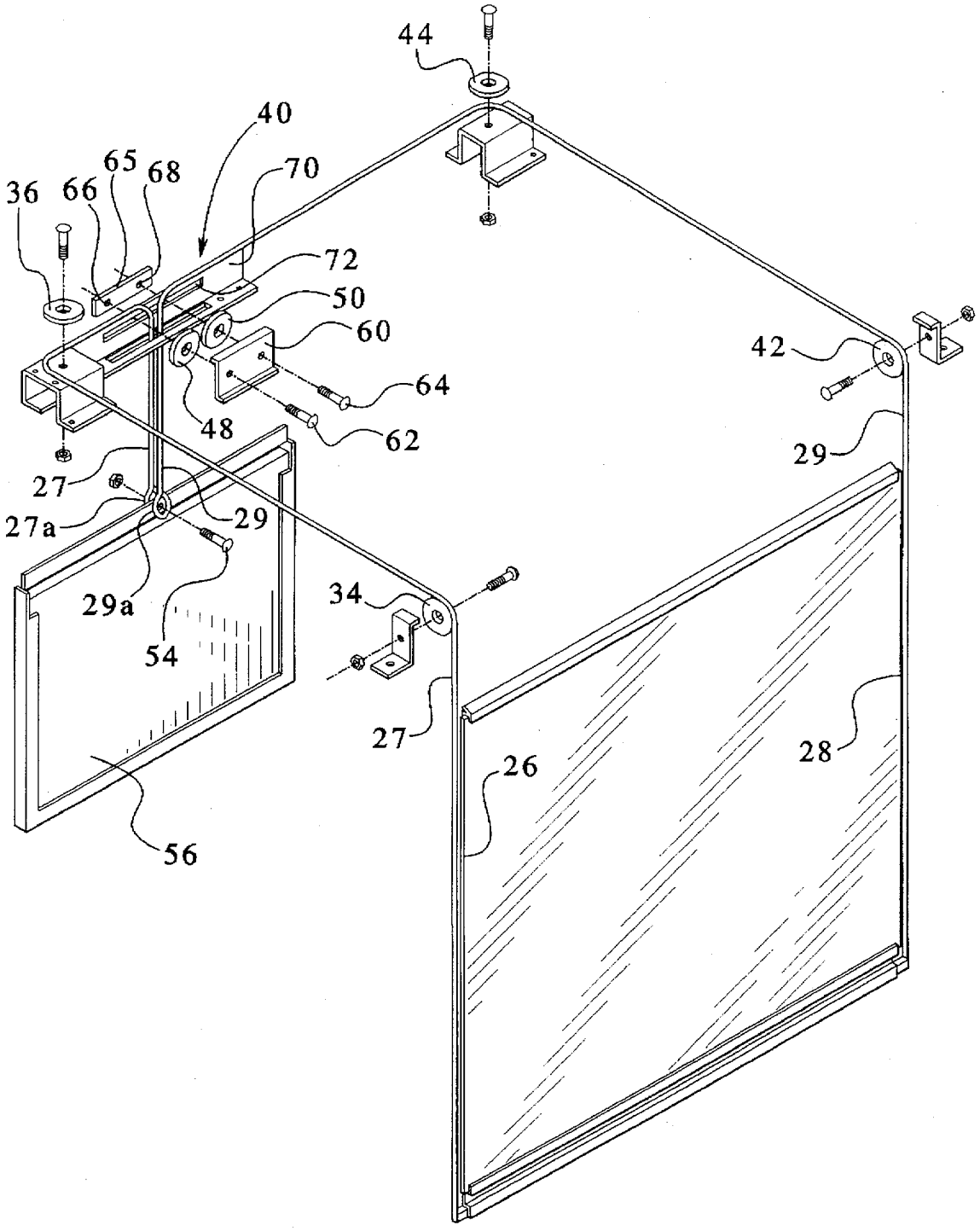
FIG. 4 is an exploded perspective view of a sash adjusting system of the present invention.

As shown in FIG. 4, the cables 27, 29, after proceeding from the pulleys 36, 44 are wrapped over adjusting pulleys 48, 50 and extended downwardly. The cables 27, 29 are attached via a fastener 54 to a counter weight 56. The cables can include looped ends *27a*, *27b* to receive the fastener.

The pulley adjusting mechanism 40 provides a sliding bracket 60 which journals pulleys 48, 50 on fasteners 62, 64. A clamping plate 65 is arranged to receive the fastener 62, 64 in tapped holes 66, 68. A fixed bracket 70 with a longitudinal slot 72 is fixed to the top wall 20 of the cabinet. The sliding bracket 60, with the fastener 62, 64 passing through the slot 72 in a loosened state, can move longitudinally along the fixed bracket 70. When the fastener 62, 64 are drawn tight into the tapped openings 66, 68, the sliding bracket 60 is drawn tight against the fixed bracket 70 by the clamping bracket 65 fixing the longitudinal position of the sliding bracket 60 with respect to the fixed bracket 70. In this drawn tight configuration, the pulleys 48, 50 are still free to rotate.

Figure 2:
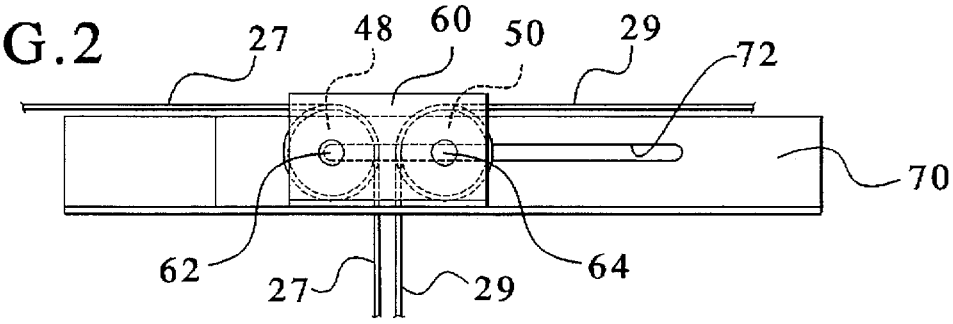
FIG. 2 is a partial elevational view of a cable adjusting mechanism of FIG. 1.
Figure 3:
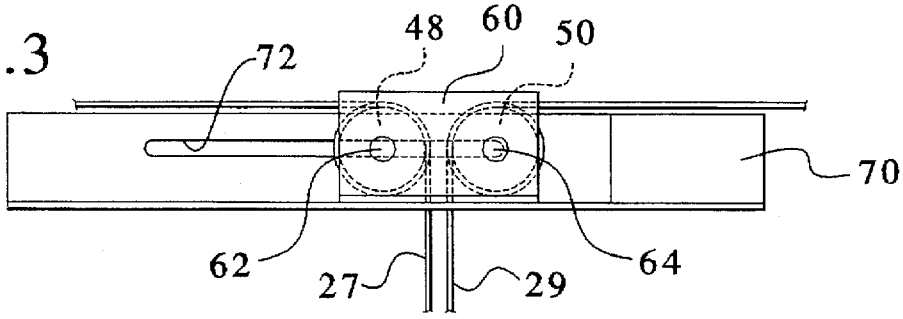
FIG. 3 is a partial elevational view according to FIG. 2 but with the cable adjusting mechanism in a different degree of adjustment.

The range of motion of the sliding bracket 60 with respect to the fixed bracket 70 is demonstrated in FIGS. 2 and 3.

To adjust the length of the cables 27, 29, the fasteners 62, 64 are loosened to permit movement of the sliding bracket 60 and the pulleys 48, 50 with respect to the fixed bracket 70. The fasteners are accessible from a front of the fume hood for ease of adjustment. The action of the counter weight then equalizes the tension in the cables 27, 29 to take up all slack in the cables 27, 29 by forcing the support bracket 60 to slide with respect to the fixed bracket. The sash is thusly adjusted for correct tension on opposite lateral sides of the sash for proper sliding movement without binding. The fasteners 62, 64 are then tightened to secure adjustment.

Although the present invention has been described with reference to a specific embodiment, those of skill in the art will recognize that changes may be made thereto without departing from the scope and spirit of the invention as set forth in the appended claims.

We claim as my invention:

1. A fume hood, comprising:

a cabinet having an open front face;

a sash vertically reciprocal in said open front face;

a first cable connected to a side of said sash and a second cable attached to a second side of said sash;

a first pulley arranged on a top of said cabinet for receiving said first cable and directing said first cable horizontally;

a second pulley arranged on a top of said cabinet and receiving said second cable and directing said second cable horizontally;

a first bracket fixed on a top of said cabinet;

a second bracket slidably positionable along said first bracket;

a pulley means connected to said second bracket for receiving said first and second cables and directing said first and second cables downwardly; and a counter weight attached to said first and second cables.

2. The fume hood according to claim 1 wherein said pulley means comprises a third and fourth pulley arranged side by side and each receiving one of said first and second cables for redirecting said first and second cables from a horizontal to a vertical orientation.

3. The fume hood according to claim 1 wherein said first bracket comprises a longitudinal slot and further comprising two fasteners penetrating said second bracket and said longitudinal slot, and a clamp bracket having threaded apertures for receiving said fasteners and arranged on an opposite side of said first bracket.

4. The fume hood according to claim 1 further comprising a first corner pulley and a second corner pulley arranged at back corners of the fume hood cabinet respectively and receiving said first cable and said second cable from said first pulley and said second pulley respectively and redirecting said first cable and said second cable horizontally to said pulley means.

5. The fume hood according to claim 1 further comprising means for fixedly positioning said first bracket to take up slack in either said first cable or said second cable respectively.

6. A suspension system for a sash reciprocally moveable vertically to close a fume hood, comprising:

a first cable connected to a first side of said sash;

a horizontal pulley means for receiving said first and second cables and directing said first and second cables from a vertical orientation to a horizontal orientation;

a fixed portion connected to said fume hood;

length adjusting pulley means for receiving said first and second cables from said horizontal pulley means and for taking up slack from one of said first cable and said second cable by adjustable horizontal positioning of said length adjusting means, said length adjusting means directing said first and second cables downwardly;

a counter weight connected to ends of said first and second cables directed from said length adjusting means; and wherein said length adjusting means comprises a slidable portion adjustably fixed to one position of said fixed portion, said slidable portion having a first adjusting pulley and a second adjusting pulley connected thereto and receiving said first and second cables respectively to direct said first and second cables from the horizontal orientation to a vertical orientation down to said counter weight.

7. The suspension system according to claim 6 wherein said horizontal pulley means comprises first and second pulleys arranged on opposite sides of said fume hood.

8. The suspension system according to claim 6 wherein said fixed portion comprises a first bracket fixed to a top of said fume hood and having a longitudinal slot therethrough, and said slidable portion comprises a second bracket holding rotatably said first and second adjusting pulleys and having means for selectively fixing said second bracket to said first bracket.

9. The suspension system according to claim 8 wherein said means for selectively fixing comprises a clamping bracket arranged behind said first bracket with threaded holes therein, and fasteners penetrating said first and second pulleys axially and fixable to said threaded apertures to clamp said first bracket between said clamp bracket and said second bracket.

10. A fume hood, comprising:

a cabinet having an open front face;

a sash vertically reciprocally mounted in said open front face;

a first cable connected to a first side of said sash, and a second cable connected to a second side of said sash;

a first pulley arranged on a top of said cabinet for receiving said first cable and directing said first cable horizontally;

a second pulley arranged on said top of said cabinet and receiving said second cable and directing said second cable horizontally;

a slide bracket mounted onto said cabinet and slidably adjustable in position;

a third pulley and a fourth pulley for receiving and redirecting said first and second cables, respectively, from a horizontal to vertical orientation, said third and fourth pulleys mounted to said slide bracket; and a counterweight connected to ends of said first and second cables and located below said slide bracket.

11. The fume hood according to claim 10, further comprising:

a fixed bracket mounted to a top of said cabinet and having a longitudinal slot; and a first fastener for fixing said slide bracket to said fixed bracket at a select position along said longitudinal slot.

12. The fume hood according to claim 11, further comprising a first corner pulley and a second corner pulley arranged at back corners on a top of said cabinet respectively and receiving said first cable and said second cable from said first pulley and said second pulley respectively and redirecting said first cable and said second cable in a horizontal plane to said third and fourth pulleys respectively.

13. The fume hood according to claim 12, further comprising a clamp bracket with a threaded aperture for receiving a threaded portion of said first fastener and arranged on an opposite side of said fixed bracket than said slide bracket.

14. The fume hood according to claim 11, further comprising a second fastener, said first and second fasteners penetrating axes of rotation of said third and fourth pulleys respectively, and supporting said third and fourth pulleys respectively for rotation; said first and second fasteners fixing said slide bracket to said fixed bracket.

15. The fume hood according to claim 10, wherein said slide bracket is adjustably slidable in a plane parallel to a plane of said sash.

* * * * *